US006193837B1

(12) United States Patent
Agblevor et al.

(10) Patent No.: US 6,193,837 B1
(45) Date of Patent: Feb. 27, 2001

(54) PREPARATION OF BRIGHTNESS STABILIZATION AGENT FOR LIGNIN CONTAINING PULP FROM BIOMASS PYROLYSIS OILS

(75) Inventors: Foster A. Agblevor, Blacksburg, VA (US); Serpil Besler-Guran, Flemington, NJ (US)

(73) Assignee: Midwest Research Institute, Kansas City, MO (US)

( * ) Notice: Subject to any disclaimer, the term of this patent is extended or adjusted under 35 U.S.C. 154(b) by 0 days.

(21) Appl. No.: 08/933,859

(22) Filed: Sep. 19, 1997

(51) Int. Cl.[7] ..... C07C 1/00; D21C 3/20

(52) U.S. Cl. ..... 162/72; 8/116.1; 201/8; 201/37; 201/39; 203/46; 568/492; 585/242

(58) Field of Search ..... 162/72; 203/46; 585/240, 242, 310; 201/7, 8, 31, 36, 37, 39; 8/116.1; 568/492

(56) References Cited

U.S. PATENT DOCUMENTS

| | | | | |
|---|---|---|---|---|
| 4,891,459 | * | 1/1990 | Knight et al. | 585/240 |
| 5,080,754 | | 1/1992 | Francis et al. . | |
| 5,181,988 | | 1/1993 | Akutsu et al. . | |
| 5,354,423 | | 10/1994 | van Heiningen et al. . | |
| 5,360,515 | | 11/1994 | Francis et al. . | |
| 5,366,593 | | 11/1994 | Lee et al. . | |
| 5,368,689 | | 11/1994 | Agnemo . | |

* cited by examiner

*Primary Examiner*—Steve Alvo

(74) *Attorney, Agent, or Firm*—Ken Richardson; Paul J. White

(57) ABSTRACT

A process for producing a brightness stabilization mixture of water-soluble organic compounds from biomass pyrolysis oils comprising:

a) size-reducing biomass material and pyrolyzing the size-reduced biomass material in a fluidized bed reactor;

b) separating a char/ash component while maintaining char-pot temperatures to avoid condensation of pyrolysis vapors;

c) condensing pyrolysis gases and vapors, and recovering pyrolysis oils by mixing the oils with acetone to obtain an oil-acetone mixture;

d) evaporating acetone and recovering pyrolysis oils;

e) extracting the pyrolysis oils with water to obtain a water extract;

f) slurrying the water extract with carbon while stirring, and filtering the slurry to obtain a colorless filtrate;

g) cooling the solution and stabilizing the solution against thermally-induced gelling and solidification by extraction with ethyl acetate to form an aqueous phase lower layer and an organic phase upper layer;

h) discarding the upper organic layer and extracting the aqueous layer with ethyl acetate, and discarding the ethyl acetate fraction to obtain a brown-colored solution not susceptible to gelling or solidification upon heating;

i) heating the solution to distill off water and other light components and concentrating a bottoms fraction comprising hydroxyacetaldehyde and other non-volatile components having high boiling points; and j) decolorizing the stabilized brown solution with activated carbon to obtain a colorless solution.

7 Claims, 2 Drawing Sheets

PREPARATION OF BRIGHTNESS STABILIZATION AGENT FOR LIGNIN CONTAINING PULP FROM BIOMASS PYROLYSIS OILS

CONTRACTUAL ORIGIN OF THE INVENTION

The United States Government has rights in this invention pursuant to Contract No. DE-AC36-83CH10093 between the United States Department of Energy and the Midwest Research Institute.

FIELD OF THE INVENTION

This invention relates to a method of extracting the water soluble fraction of biomass pyrolysis oils from pyrolysis oils and using these extracts to maintain the brightness of bleached pulps and paper containing lignin. Maintaining brightness in the pulp and paper manufacturing industry is also known as retarding or reducing brightness reversion.

BACKROUND OF THE INVENTION

Pulp is the raw material used in the production of paper, paper board, fiber board and the like, and is obtained from plant fiber such as wood, straw, bamboo and sugar cane residues.

Wood is the source of 95% of the pulp fiber produced in the United States, and dry wood consists of 40 to 50% cellulose, 15 to 25% other polysaccharides known as hemicelluloses, 20–30% lignin (a biopolymer that acts as a matrix for the cellulose fibers), and about 5% of other substances such as mineral salts, sugars, fatty acids, resins and proteins.

Lignin is composed primary of methoxylated phenylpropane monomeric units interconnected by a variety of stable carbon—carbon and carbon-oxygen (ether) linkages. The color of paper produced from pulp arises essentially from the lignin.

Since paper or pulps containing lignin or lignocellulose are commonly dark, they must be bleached if a white paper is desired; however, a major disadvantage or draw back of bleached lignin-containing pulps is that they are easily and extensively darkened by light irradiation, and this darkening process limits use of these pulps in various grades of printing papers.

In making newsprint, the paper of pulp used in the process is generally not bleached. However, if it is bleached, it is relatively mildly bleached compared to a higher quality paper than newsprint. Such unbleached or mildly bleached pulps have a darker quality than bleached pulps. Since news print has a relatively high lignin content, it has a tendency to become even darker when exposed to light.

One means for determining whiteness of paper is estimated by brightness measurements which are based on the reflectance of light having an average wavelength of about 457 nm. And Elrepho Brightness Meter is one type of instrument used to measure paper brightness. In this measurement, a low brightness (40% Elrepho) indicates brown or dark paper, while 90% Elrepho is typically white paper. Lignin-rich pulps have brightness values in the range of about 50–70% Elrepho depending upon the wood species used and the pulping process. In the pulping process, these pulps can be bleached to 70–90% brightness using known brighteners such as hydrogen peroxide, sodium borohydride or sodium dithionite. When a brightness of more than 70% is required, hydrogen peroxide is normally used; however, a problem or drawback associated with bleached lignin-rich pulps is that they may darken by as much as 20 Elrepho points when exposed to natural sunlight during exposure over a period of only one day.

Another method of determining brightening imparted by a brightening agent is to observe the extent of lowering of the light absorption coefficient (LAC).

While several methods are known to decrease light-induced brightness reversion in pulps containing high levels of lignin, they accelerate the yellowing that occurs in routine storage in the dark (thermal reversion), and the disadvantage of these methods is that they add significantly to the cost of the paper manufacturing process.

The use hydroxyacetaldehyde (HAA), also known as glycolaldehyde dimer has been used per se to prevent brightness retardation in lignin-containing paper; however, various means of producing HAA, inclusive of the pyrolysis of carbohydrate containing feedstocks and distillation of pyrolysis products under reduced pressure to provide pure HAA at 2% yield ([1,2]) at a cost of about $18.00/gram, makes the use of HAA at these prices prohibitive in paper manufacturing.

1. Stradal, J. A. and Underwood, G. L., *Process for Producing Hydroxyacetaldehyde by pyrolysis of carbohydrate-containing feed stocks and artifical tanning agent containing the product*, PCT Int. Appl. WO 91/14379 (Oct. 3, 1991).

2. Scott, D. S., *Pyrolysis of Biomass to Produce Maximum Liquid Yields*, PCT Int. Appl. WO 88/00 935 (Feb. 3, 1988).

One known method is described in European patent No. 0 280 332 (Agnemo et al.) consists of several treatments to reduce the carbonyl groups (photosensitizers) contained in the pulp to alcohol groups. In addition, this process includes alkylation of the phenolic hydroxyl groups in the lignin, from which hydrogen atoms are abstracted, by the use of an alkaline propylene oxide. The addition of fluroescent compounds that absorb or reflect the ultraviolet light which would otherwise excite photosensitizer groups is also disclosed.

The bleaching of pulp in-situ to remove lignin from pulp to maintain the brightness is disclosed in U.S. Pat. No. 5,366,593. The patent also discloses the use of dioxirane.

U.S. Pat. No. 5,354,423 discloses the use of a gaseous bleaching agent such as ozone to impregnate pulp in the presence of dioxane. A bleaching action takes place which removes the lignin from the final pulp product without destroying the cellulose in the pulp.

A method for stabilizing the pulp or paper containing lignin, is disclosed in U.S. Pat. No. 5,368,689; however, while this process is like those mentioned in the two foregoing patents, the method in this patent is not a method for producing a brightness stabilization agent.

U.S. Pat. No. 5,080,754 discloses a methodology for stabilizing the brightness of lignin-containing pulps. In this process, formic acid and its derivatives either alone or in combination with copper sulfate or ascorbic acid are used to stabilize the brightness reversion reactions such as photo-yellowing of the paper.

A method for reducing thermal and light-induced brightness reversion in lignin-containing pulps is disclosed in U.S. Pat. No. 5,360,515. This patent utilizes 2,5-dihydroxydioxane or glycoaldehyde dimer to reduce brightness reversion in bleached lignin-containing pulps or newsprint.

A method for preventing the discoloration of paper and paper treated to prevent discoloring is disclosed in U.S. Pat. No. 5,181,988, and this method is similar to those described in the foregoing patents in that it is independent of a chemical manufacturing process, and utilizes hypophosphorous acid to reduce brightness reversion in pulp and paper.

All pulps can be divided into two main classes, chemical and mechanical pulps. Chemical pulps are made by application of chemicals to wood chips to dissolve sufficient lignin from the middle lamella and subsequently defibrate the fibers without any mechanical action. The dominant chemical wood-pulping process is the Kraft or sulfate process.

Mechanical pulps are made by defibrating wood through mechanical action such as grindstone, refiner disks, or thermomechanical process. Mechanical pulping processes retain most of the lignin in the wood and therefore the yields are usually very high (93–95% based on wood). Mechanical pulp production in the USA was about 11% of the total pulp produced in 1992. On a world wide basis, mechanical pulp production consistituted about 22% of the total pulp production in 1992. The large differences in the production of these two pulps stem from quality issues. For example, the production of mechanical pulp has the following advantages compared to chemical pulps:

It is less capital intensive (50% of the cost of Kraft Mill); it consumes less wood (50% less than chemical pulp); it consumes less energy than chemical pulp production (33% of Kraft Mill); there is reduced emission of odorous compounds and sulfur dioxide which contributes to acid rain; the use of environmentally benign chemicals eliminates the concerns about dioxins, chlorinated furans, and other chlorinated organics; and there is zero liquid effluent discharges using modern technology.

However, a major quality problem with mechanical pulps is yellowing of the paper on exposure to light or thermal sources. This phenomenon known as brightness reversion confines mechanical pulps to low value applications where brightness reversion is not very criticial, such as: newsprints, catalogs, magazines, paperboards, and toilet tissues. But, if brightness reversion could be stabilized in mechanical pulps, these pulps would find application in high quality paper products and some current chemical pulp capacity could be shifted to mechanical pulps and thus the referred to energy, environmental and sustainable resource benefits could be realized on a much larger scale.

Because environmental pollution is now a major public concern, the state-of-art pulp and paper mill will ultimately be defined by environmental issues.

Therefore, such plants would be required to: maximize recycling of post consumer waste; use chlorine-free bleaching to eliminate potential for chlorine compound emissions; become more energy efficient to reduce power plant emissions; use incineration to reduce landfilling; and be characterized by zero liquid effluent discharge. One important route to make mechanical pulps more widely applicable to high-value grades of printing and writing papers and other products is to reduce or stabilize brightness reversion in these mechanical pulps. It is estimated that, if brightness reversion in mechanical pulps can be limited to less than 3% over 3–12 months, usage of these pulps could increase two to six fold. Thus, a large market could develop very rapidly if a suitable brightness stabilization technology could be provided more efficiently and less expensively than at the present cost of about $18.00 per gram or $80.00 per 5 grams for pure HAA.

SUMMARY OF THE INVENTION

Figure 1:
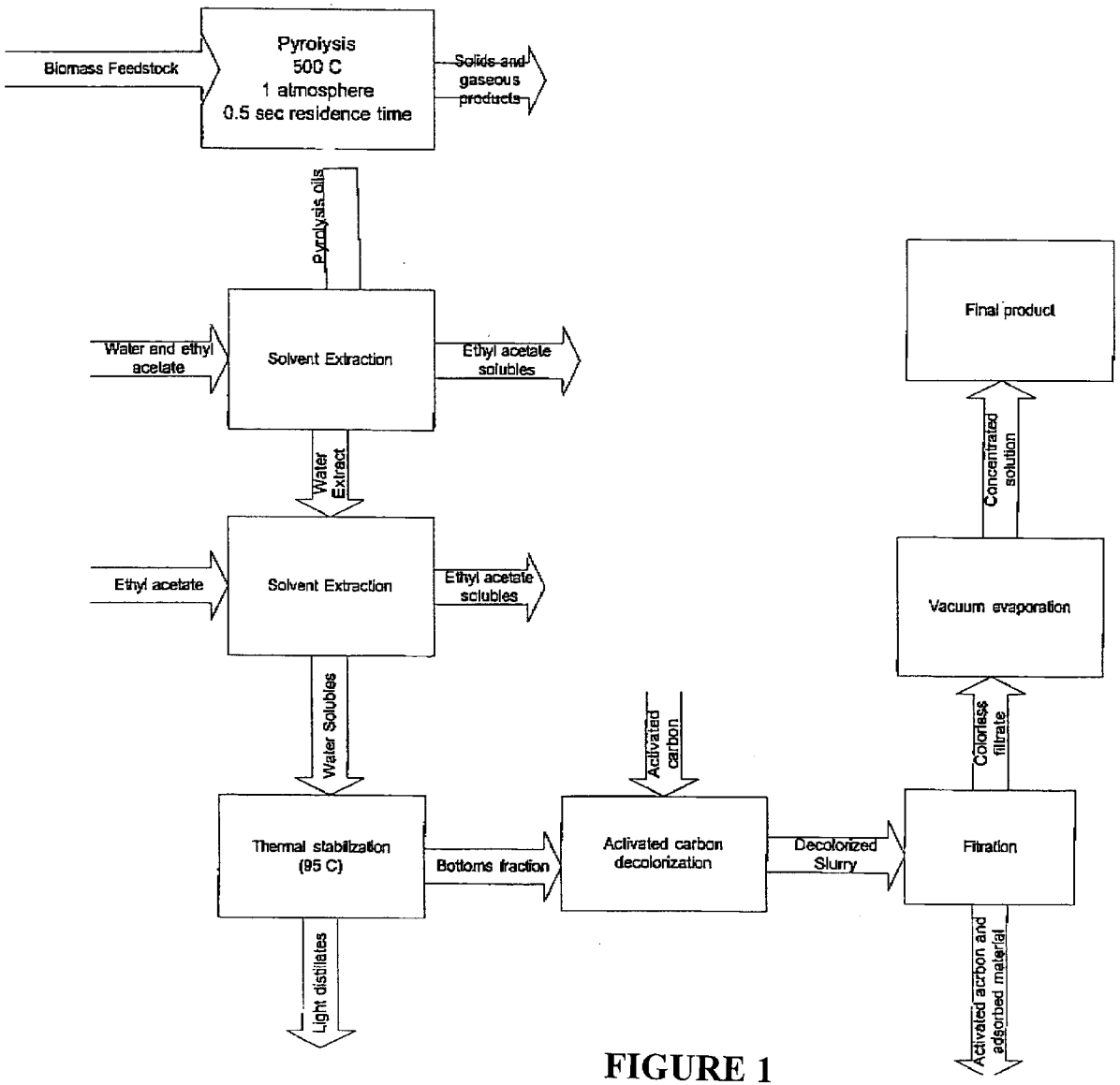
FIG. 1 is a schematic flow chart showing production of the brightness stabilization agent obtained from pyrolysis of biomass feed stock.

One object of the invention is to make mechanical pulps more widely applicable to high-value grades of printing and writing papers and other products by utilizing a more efficient and stable method to reduce or stabilize brightness reversion in these pulps.

Another object of the invention is to provide a pyrolysis and extraction methodology for producing a complex mixture of water-soluble organic compounds from biomass pyrolysis oils that is useful for reducing brightness reversion in lignin-containing pulps or paper.

A yet further object of the invention is to provide a pyrolysis and extraction methodology for producing a complex mixture of water-soluble organic compounds from biomass pyrolysis oils that is more effective in its stabilizing effect on brightness reversion in lignin-containing pulps than HAA per se, and that is less costly, i.e. about 1 to 2 dollars per pound versus about $80 per 5 grams or $18.00/gram for the pure HAA.

In general, the invention is accomplished by pyrolyzing biomass such as waste newsprint in a fluidized bed reactor to obtain a pyrolysis oil. The pyrolysis oil is extracted with distilled water, and the water extract is slurried in activated carbon with stirring, whereupon the slurry is filtered through a glass filter to obtain a colorless filtrate. The colorless filtrate solution is analyzed by HPLC and the concentration of hydroxyacetaldehyde (HAA) in this solution was 1%. The solution is concentrated by vacuum evaporation, and was found to be sensitive to pH, light, and heat—i.e. exposure to these agents either alone or in combination causes the solution to turn yellow and eventually brown. The solution is stabilized against thermally-induced gelling and solidification by solvent extraction with ethyl acetate, to obtain an aqueous phase and an organic phase (upper layer) which is discarded.

The solvent extracted aqueous phase solution is unstable to pH, light, and heat; however, thermal stabilization of the solution is accomplished by heating the solution to about 95° C. to distill off water and other light components while concentrating the bottoms fraction that contain hydroxyacetaldehyde and other non-volatile components having high boiling points.

The thermally stabilized brown solution is decolorized with activated carbon and is stable at room temperature in a white or colorless bottle for more than a year. The thermally stabilized solution is used to stabilize brightness reversion in lignin-containing papers at concentrations as low as 3% by weight of the paper or pulp.

DETAILED DESCRIPTION OF THE INVENTION

The water-soluble pyrolysis oil fraction used to retard or reduce brightness reversion may be obtained from pretreated cellulose, waste newsprint, or lignocellulosic feedstocks such as softwoods, hardwoods, herbaceous biomass (e.g. switchgrass, sericea lespedeza) and agricultural residues (e.g. wheat straw, sugar cane bagasse).

As mentioned, the water-soluble pyrolysis oil fraction has been found to be an effective brightness stabilization agent for lignin-containing pulps and paper when applied at low concentrations. This water-soluble fraction from pre-treated biomass materials is a mixture of aldehydes, ketones, organic acids, and sugars, with the predominant component in this mixture being hydroxyacetaldehyde (HAA), also known as glycolaldehyde.

EXAMPLE 1

Waste newsprint was ground to −20/+40 mesh and pyrolyzed in a fluidized bed reactor. The fluidized bed media was silica sand and the bed was fluidized with nitrogen gas. The pyrolysis temperature was kept at 500–550° C. and the ambient gas flow rate was 26 L/min. The resident time for the pyrolysis products in the reactor was less than 0.4–0.6 seconds. The nitrogen and pyrolysis gases and vapors exiting the reactor passed through a heated cyclone to separate char/ash and any entrained sand. The cyclone and char-pot temperatures were maintained at 400° C. to avoid condensation of the pyrolysis vapors in these units. The pyrolysis gases and vapors were then passed through a condensation train consisting of a chilled water condenser, an ice/salt mixture condenser, an electrostatic precipitator, and a cotton wool trap (all connected in series). The electrostatic precipitator was maintained at 15–20 kV.

The gaseous products were analyzed by gas chromatography using an on-line HP 5890 Series II instrument. Gaseous products were sampled and analyzed every thirty minutes during the run. Total gas volume was measured by a dry test meter. To ensure good mass balance, the entire set-up (excluding the dry test meter) was weighed before and after each run.

Pyrolysis oils were recovered (after weighing the pyrolysis unit) by rinsing the condensers and cotton wool trap with acetone. The oil-acetone mixture was filtered through a 40–60 $\mu$m fritted glass filters. The moisture content of the final filtrate was determined by Karl Fischer analysis. The weight of the acetone-insoluble fraction of the filtrate was added to the weight of the char recovered from the char-pot and the fluidized bed reactor, and these were recorded as total char/ash produced from each run. The acetone was evaporated under vacuum (40° C. and 61.3 kPa), and the recovered oils were fractionated as described hereafter. During the vacuum evaporation process, some of the volatile oils components such as acetaldehyde, methanol, and formaldehyde may have been lost, but no investigation to detect losses were made.

Fractionation of Pyrolysis Oil

A schematic flow chart of the extraction process is shown in FIG. 1. In the extraction process, 187.7 g of waste newsprint pyrolysis oil was extracted with 1100 mL distilled water three times, to arrive at a total volume of 3300 mL. The water extract was slurried with 300 g activated carbon and stirred continuously over night. The slurry was then filtered through a 100 mL medium porosity (10–15 $\mu$m) glass filter. The resulting filtrate was colorless.

The colorless solution was analyzed by HPLC and the concentration of hydroxyacetaldehyde (HAA) in the solution was 1%. The solution was then concentrated to 50 mg/mL (5%) by rotary vacuum evaporation. The evaporation of the water was accelerated by the addition of azeotropic quantities of octane, and the evaporation was carried out at 20 inches Hg at 40° C.

This solution as prepared was sensitive to pH, light and heat. Consequently, exposure to any of these agents either alone or in combination will cause the solution to initially turn yellow and eventually brown. The pH of the solution after the extraction was 2.5–3.0. When the pH is raised to 5 by addition of a base, the color of the solution turns yellow and eventually brown. When this colorless solution is first exposed to light the color gradually turns to faint yellow and after several weeks exposure, the color eventually turns brown.

When the solution is heated, the water component and other low molecular weight compounds such as formaldehyde distill over and the color of the solution turns rapidly from yellow to brown accompanied by a rapid increase in viscosity. A rapid reaction takes place between 94° to 104° C. and the solution viscosity increases. When the heating is stopped at this stage and the products cooled to room temperature, the solution quickly gels and eventually forms a very brittle solid which is not readily soluble in common solvents.

The solution is stabilized against thermally-induced gelling and solidication by solvent extraction, and solvent extraction of the solution is performed with ethyl acetate (100 mL) by shaking for several minutes in a separatory funnel. The mixture is allowed to settle and phase separate. The aqueous phase is withdrawn from the bottom layer and kept while the upper layer (the organic phase) is withdrawn and discarded. The organic phase has a yellow color. The aqueous fraction is further extracted with ethyl acetate for a total of 3×100 mL. The final aqueous phase is kept and all the organics discarded.

This solvent extracted solution is also unstable towards the three factors of pH, light, and heat, with the exception that it will not gel or solidify when heated.

Thermal Stabilization of the Solution

The solution is heated to 95° C. to distill off water and other light components while concentrating the bottoms fraction. The bottoms fraction contain hydroxyacetaldehyde and other non-volatile components which have high boiling points. During the distillation process, the solution gradually undergoes color change from yellow to brown. This operation has three advantages for the process. First, it converts all the heat-sensitive chemical components to colored bodies, and secondly, the light fractions (e.g. formaldelhyde, formic acid) which have been shown to be detrimental to the pulp brightness stabilization are distilled off. Thirdly, the water content of the mixture is reduced. After the concentration and distillation, the bottoms fraction has dark brown color while the distillate is colorless. During this operation neither gelling nor solification was observed. This solution is thermally stabilized.

The thermally stabilized brown solution is decolorized with activated carbon to a colorless solution. This solution decolorizes faster than the original water-extracted solution. For example, whereas the first or original solution required 1.2 g carbon to 12 mL of solution and continuous stirring over night before decolorization, the thermally stabilized solution will decolorize when filtered through a shallow bed of activated carbon without premixing the solution with the activated carbon.

The resulting solution is colorless and is stable at room temperature in a white bottle for over one year. No color change was observed during the one year period.

Figure 2:
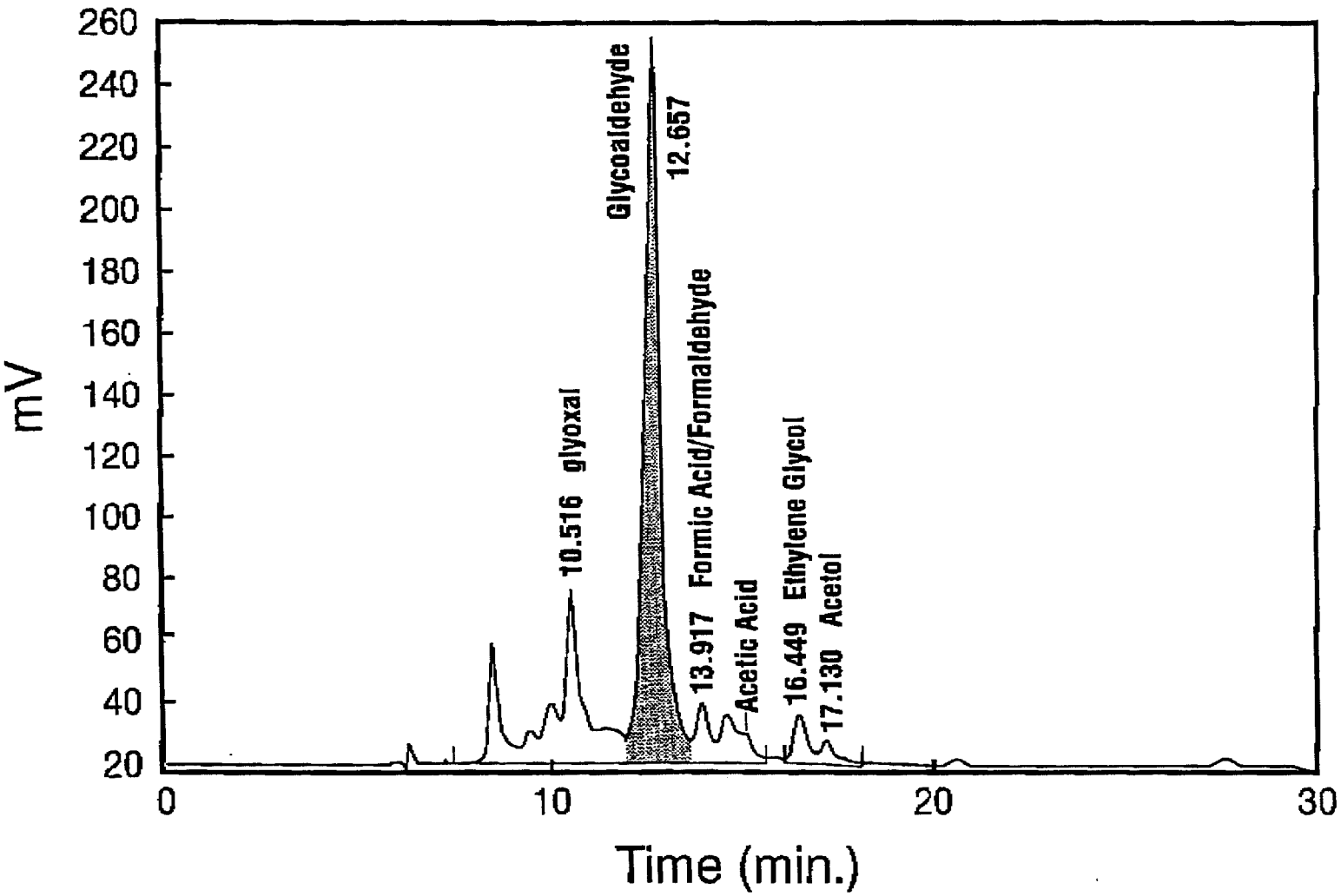
FIG. 2 is a graph of HPLC analysis of the brightness stabilization agent solution produced by the invention process.

HPLC analysis of the brightness stabilization agent solution is shown in FIG. 2 and partial composition of the solution is shown in Table (1).

TABLE 1

HPLC analysis of biomass pyrolysis brightness reversion agent (list of compounds detected and quantified).

| Compound | Concentration (Wt %) Purified Solution | Distillate # | Raw water extract |
|---|---|---|---|
| Hydroxyacetaldehyde (HAA) | 5.5 | 0.38 | d** |
| Glucose | 0.3 | n/d* | d |
| Glyoxal | 0.99 | 0.02 | d |

TABLE 1-continued

HPLC analysis of biomass pyrolysis brightness reversion agent (list of compounds detected and quantified).

| Compound | Concentration (Wt %) Purified Solution | Distillate # | Raw water extract |
|---|---|---|---|
| Levoglucosan | 2.6 | n/d | d |
| Acetic acid | 1.0 | 0.20 | d |
| Formaldehyde | n/d | 0.04 | d |
| Acetol | n/d | 0.02 | d |
| Formic acid | n/d | n/d | d |
| Furfural | n/d | n/d | d |
| 5-hydroxyl methyl Furfural | n/d | n/d | d |
| Ethylene glycol | n/d | n/d | d |
| Others | | | |

*n/d = not detected; **d = detected but not quantified; #fraction of water/ethyl acetate-extract which distilled over during thermal stabilization.

TABLE 2

| | Initial LAC | Increase in LAC after | | Aged Brightness | Thermal reversion LAC after |
|---|---|---|---|---|---|
| Aging Time | O hours | 1 hour | 3 hours | 5 days | 10 days |
| BCTMP[a] | 2.04 | 2.05 | 3.74 | 59.4 | 2.08 |
| BCTMP + HAA[b(pure)] | 1.87 | 1.46 | 2.73 | 62.1 | 1.83 |
| BCTMP + pyrolysate[c] | 1.87 | 1.43 | 2.39 | 62.7 | 2.12 |

[a]BCTM = bleached thermomechanical pulp
[b]HAA = hydroxyacetaldehyde
[c]pyrolysate = brightness stabilization agent from biomass pyrolysis oil Referring to Table 2 above, when 3% by weight of the biomass pyrolysis oil obtained from the process of the invention is coated onto a sheet of paper containing pulp, the light absorption coefficient (LAC) increases less over the course of three hours than is the case with bleached thermomechanical pulp per se or a combination of bleached thermomechanical pulp+3% by weight of pure hydroxyacetaldehyde.

Brightening (i.e. lowering of light absorption coefficient, LAC) or lessened increase in the LAC with the progression of time is superior using the water-soluble organic compounds from biomass pyrolysis oils obtained by the process of the invention.

While the results in Table 2 were conducted with 3% by weight of the biomass pyrolysis oil obtained from the process of the invention, comparable results in brightening may be obtained when the biomass pyrolysis oil is used in amounts from about 1 to about 8% by weight.

EXAMPLE 2

Hybrid poplar, a hardwood, was pyrolyzed under conditions similar to those described in EXAMPLE 1. The resulting pyrolysis oils were water and solvent extracted as described in EXAMPLE 1. The resulting solution was analyzed by HPLC and found to have a similar composition as the solution in EXAMPLE 1. This solution was found to be effective as a brightness stabilization agent for lignin-containing paper or pulps.

EXAMPLE 3

Sugar cane bagasse (agricultural residue) was pyrolyzed as described in EXAMPLE 1, and the resulting solution had a similar composition as EXAMPLE 1 when analyzed by HPLC. This solution was found to be an effective brightness stabilizing agent for lignin-containing pulps and paper.

EXAMPLE 4

Switch grass (a herbaceous biomass) was pyrolyzed and the pyrolysis oil was extracted as described in EXAMPLE 1. Analysis of this solution by HPLC revealed that this solution had a similar chemical composition as EXAMPLE 1. The solution was found to be effective as a brightness stabilizing agent for lignin-containing pulps.

EXAMPLE 5

Monterey pine (*Pinus radiata*), a softwood, was pyrolyzed and the pyrolysis oil was extracted as described in EXAMPLE 1. Analysis of this solution by HPLC showed that this solution had a similar chemical composition as EXAMPLE 1, and was found to be effective as a brightness stabilizing agent for lignin-containing paper or pulps.

The invention method for producing a brighteness stabilization mixture of water-soluble organic compounds from biomass pyrolysis oil that is used to stabilize lignin-containing pulps, is a complex mixture containing over 10 compounds, including some formic compounds such as formic acid. The complex mixture obtained by the process of the invention can be used effectively to reduce brightness reversion in paper or pulp. Further, the complex mixture of water-soluble organic compounds from biomass pyrolysis oils of the invention has been found to be more effective in its stabilizing effect on brightness reversion in lignin-containing pulps than 2,5-dihydroxydioxane.

Based upon the foregoing description, a skilled person in the art may easily practice the essential characteristics of the invention, without departing from the spirit and scope thereof, by making various changes and modifications to the invention in order to adapt it to various usages and conditions.

What is claimed is:

1. A process for producing a brightness stabilization mixture of water-soluble organic compounds from biomass pyrolysis oils, said mixture being useful to stabilize lignin-containing pulps and paper, comprising:

a) reducing the size of biomass material, pyrolyzing said size-reduced biomass material in a fluidized bed reactor in the presence of an inert gas at temperatures between about 500° C. to about 550° C. and at a gas flow rate such that reactor residence time for pyrolysis products is less than about 0.4 to 0.6 seconds;

b) separating a char/ash component from pyrolysis gasses and vapors while maintaining char-pot temperatures at about 400° C. to avoid condensation of pyrolysis vapors;

c) condensing pyrolysis gases and vapors, and recovering pyrolysis oils by mixing said pyrolysis oils with acetone to obtain an oil-acetone mixture;

d) evaporating acetone and recovering pyrolysis oils;

(e) extracting the recovered pyrolysis oils with water to obtain a water extract;

(f) slurrying said water extract with activated carbon while stirring, and filtering said slurry to obtain a colorless filtrate solution having a pH of about 2.5–3.0;

(g) stabilizing said filtrate solution against thermally-induced gelling and solidification by extraction with ethyl acetate to form an aqueous phase lower layer and an organic phase upper layer;

(h) discarding said upper organic layer and extracting the aqueous layer of ethyl acetate, and discarding the ethyl acetate fraction to obtain a yellow-colored solution not susceptible to gelling or solidification upon heating;

(i) heating the solution to distill off water and other light components and concentrating a bottoms fraction comprising hydroxyacetaldehyde and other non-volatile components having high boiling points; and (j) decolorizing the stabilized brown solution with activated carbon to obtain a brightness stabilization colorless solution containing water soluble organic compounds.

2. The process of claim 1 wherein, in step a), said size-reduced biomass material is reduced to about −20/+40 mesh.

3. The process of claim 2 wherein, in step (i), said solution is heated to about 95° C.

4. The process of claim 3 wherein, in step c), said oil-acetone mixture is additionally filtered through 40–60 $\mu$m fritted glass filters.

5. The process of claim 4 wherein, in step d), said acetone is evaporated under a vacuum of about 61.3 kPa at about 40° C.

6. The process of claim 5 wherein, in step c), said condensing is performed by a train consisting of a chilled water condenser, an ice/salt mixture condenser, an electrostatic precipitator, and a cotton wool trap connected in series; said electrostatic precipitator being maintained at about 15–20 kV.

7. The process of claim 1 wherein said biomass material is selected from the group consisting of wood, straw, sugarcane bagasse, linen, and rags.

* * * * *